US009739469B2

(12) United States Patent
Park et al.

(10) Patent No.: US 9,739,469 B2
(45) Date of Patent: Aug. 22, 2017

(54) LIGHTING DEVICE

(75) Inventors: In Soo Park, Seoul (KR); Sun Ho Kim, Seoul (KR); Jae O Kwak, Seoul (KR); Seung Kyun Hong, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 80 days.

(21) Appl. No.: 14/240,317

(22) PCT Filed: Aug. 30, 2012

(86) PCT No.: PCT/KR2012/006920
§ 371 (c)(1),
(2), (4) Date: Feb. 21, 2014

(87) PCT Pub. No.: WO2013/032239
PCT Pub. Date: Mar. 7, 2013

(65) Prior Publication Data

US 2014/0211478 A1 Jul. 31, 2014

(30) Foreign Application Priority Data

Aug. 30, 2011 (KR) ..... 10-2011-0086859
Sep. 9, 2011 (KR) ..... 10-2011-0091542

(51) Int. Cl.
*F21V 29/00* (2015.01)
*F21V 29/67* (2015.01)
(Continued)

(52) U.S. Cl.
CPC ..... *F21V 29/67* (2015.01); *F21K 9/233* (2016.08); *F21V 5/04* (2013.01); *F21V 17/12* (2013.01);
(Continued)

(58) Field of Classification Search
CPC ..... F21V 17/12; F21V 29/02; F21V 29/83; F21V 5/04
(Continued)

(56) References Cited

U.S. PATENT DOCUMENTS 7,628,513 B2 * 12/2009 Chiu ..... 362/311.02
7,871,184 B2 * 1/2011 Peng ..... 362/294
(Continued)

FOREIGN PATENT DOCUMENTS

CN 201706458 U 1/2011
EP 2 312 202 A1 4/2011
(Continued)

OTHER PUBLICATIONS

English Translation only of Chinese Office Action dated Mar. 18, 2015 issued in Application No. 201280042436.6.
(Continued)

*Primary Examiner* — Tsion Tumebo
(74) *Attorney, Agent, or Firm* — KED & Associates, LLP

(57) ABSTRACT

A lighting device including: a light emitting module; a heat sink which is disposed on the light emitting module; a heat sink fan which is disposed over the heat sink; an upper case which covers the heat sink fan and the heat sink; and a lower case which is coupled to the upper case and fixes the light emitting module. A first air inlet is disposed in the lower case. A second air inlet is disposed in the upper case.

19 Claims, 16 Drawing Sheets

(51) Int. Cl.

| | |
|---|---|
| ***F21V 29/74*** | (2015.01) |
| ***F21V 29/02*** | (2006.01) |
| ***F21V 17/12*** | (2006.01) |
| ***F21V 5/04*** | (2006.01) |
| ***F21V 29/507*** | (2015.01) |
| ***F21V 29/83*** | (2015.01) |
| ***F21K 9/233*** | (2016.01) |

(52) U.S. Cl.
CPC ..... *F21V 29/02* (2013.01); *F21V 29/507* (2015.01); *F21V 29/74* (2015.01); *F21V 29/83* (2015.01)

(58) Field of Classification Search
USPC ..... 362/294, 373
See application file for complete search history.

(56) References Cited

U.S. PATENT DOCUMENTS

| | | | | |
|---|---|---|---|---|
| 8,541,932 | B2 * | 9/2013 | Horng | 313/46 |
| 8,562,179 | B2 * | 10/2013 | Li et al. | 362/294 |
| 2006/0193139 | A1 * | 8/2006 | Sun | F21V 29/006 362/373 |
| 2009/0237932 | A1 * | 9/2009 | Lee | 362/249.02 |
| 2010/0020537 | A1 | 1/2010 | He et al. | |
| 2010/0026185 | A1 | 2/2010 | Betsuda et al. | |
| 2010/0060130 | A1 * | 3/2010 | Li | F21V 29/004 313/46 |
| 2010/0246166 | A1 | 9/2010 | Hsu et al. | 362/184 |
| 2010/0295436 | A1 | 11/2010 | Horng et al. | 313/46 |
| 2011/0037368 | A1 * | 2/2011 | Huang | F21V 29/02 313/46 |
| 2011/0170287 | A1 | 7/2011 | Medinis | 362/235 |
| 2011/0181167 | A1 * | 7/2011 | Cho | F21K 9/137 313/46 |
| 2011/0193463 | A1 * | 8/2011 | Daniel | 313/46 |
| 2011/0317412 | A1 * | 12/2011 | Paik et al. | 362/235 |
| 2011/0317428 | A1 * | 12/2011 | Paik et al. | 362/294 |
| 2012/0008330 | A1 * | 1/2012 | Horng | F21S 8/02 362/373 |
| 2012/0146481 | A1 * | 6/2012 | Li | F21V 29/02 313/46 |
| 2012/0212960 | A1 * | 8/2012 | Rodriguez | F21K 9/50 362/249.02 |
| 2012/0268930 | A1 * | 10/2012 | Lu | F21K 9/137 362/235 |
| 2012/0287651 | A1 * | 11/2012 | Hirata | F21V 29/02 362/373 |
| 2012/0300475 | A1 * | 11/2012 | Kim | 362/373 |
| 2013/0301259 | A1 * | 11/2013 | Ahn | F21V 29/02 362/235 |

FOREIGN PATENT DOCUMENTS

| | | |
|---|---|---|
| JP | 2010-040221 | 2/2010 |
| JP | 2010-153198 | 7/2010 |
| KR | 10-2009-0004463 A | 1/2009 |
| KR | 10-2010-0114789 A | 10/2010 |
| TW | 201035481 A1 | 10/2010 |
| WO | WO 2011/005314 A2 | 1/2011 |

OTHER PUBLICATIONS

European Search Report dated Dec. 10, 2014 issued in Application No. 12 829 045.9.
International Search Report dated Jan. 29, 2013 issued in Application No. PCT/KR2012/006920.
Japanese Office Action dated Jun. 21, 2016 issued in Application No. 2014-528280.

* cited by examiner

[Fig. 1]
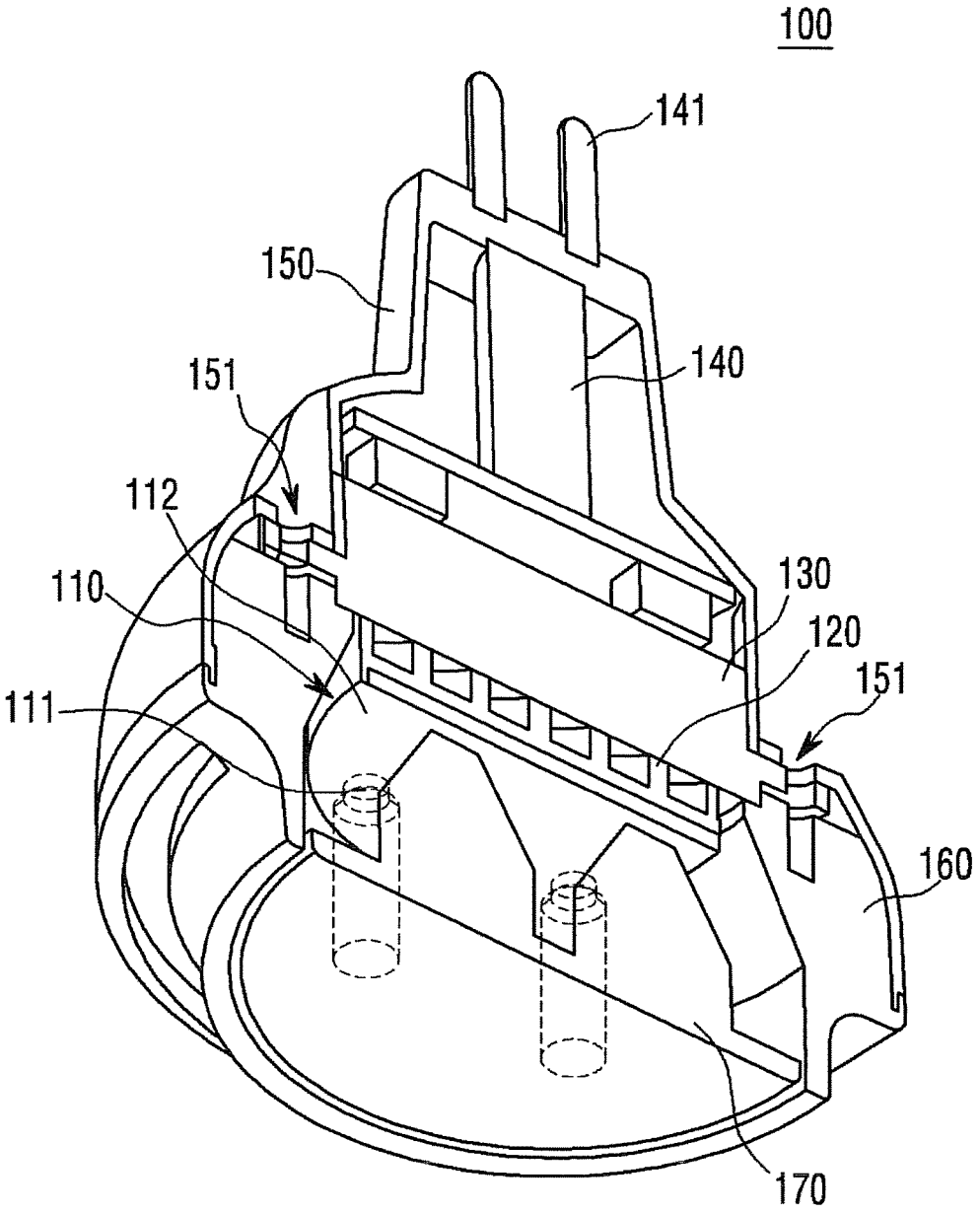

[Fig. 2]
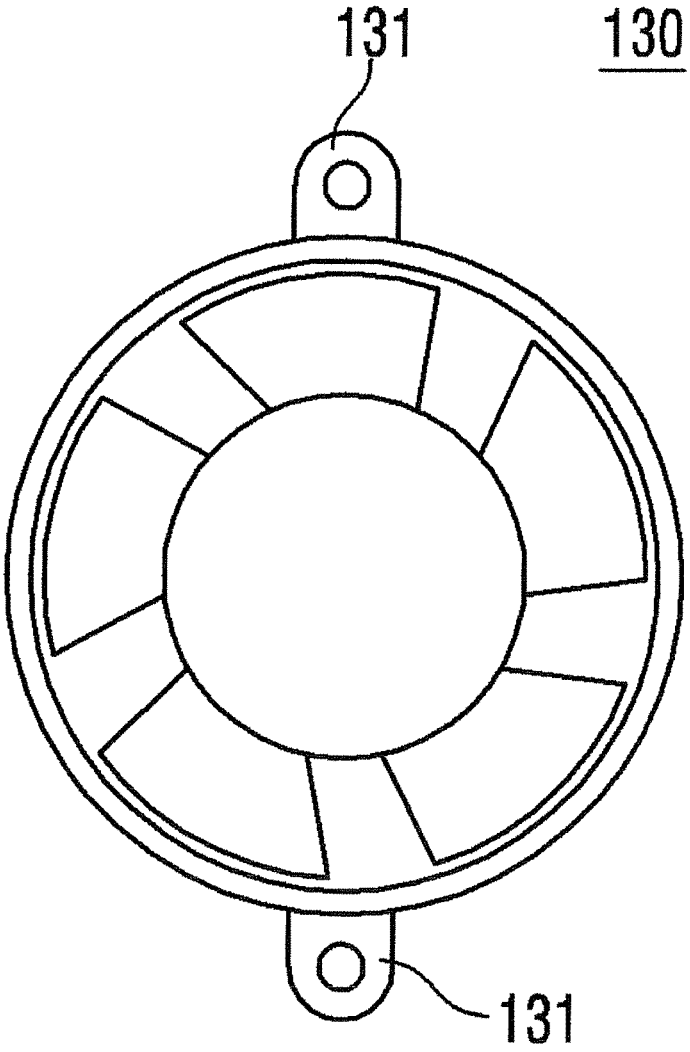

[Fig. 3]
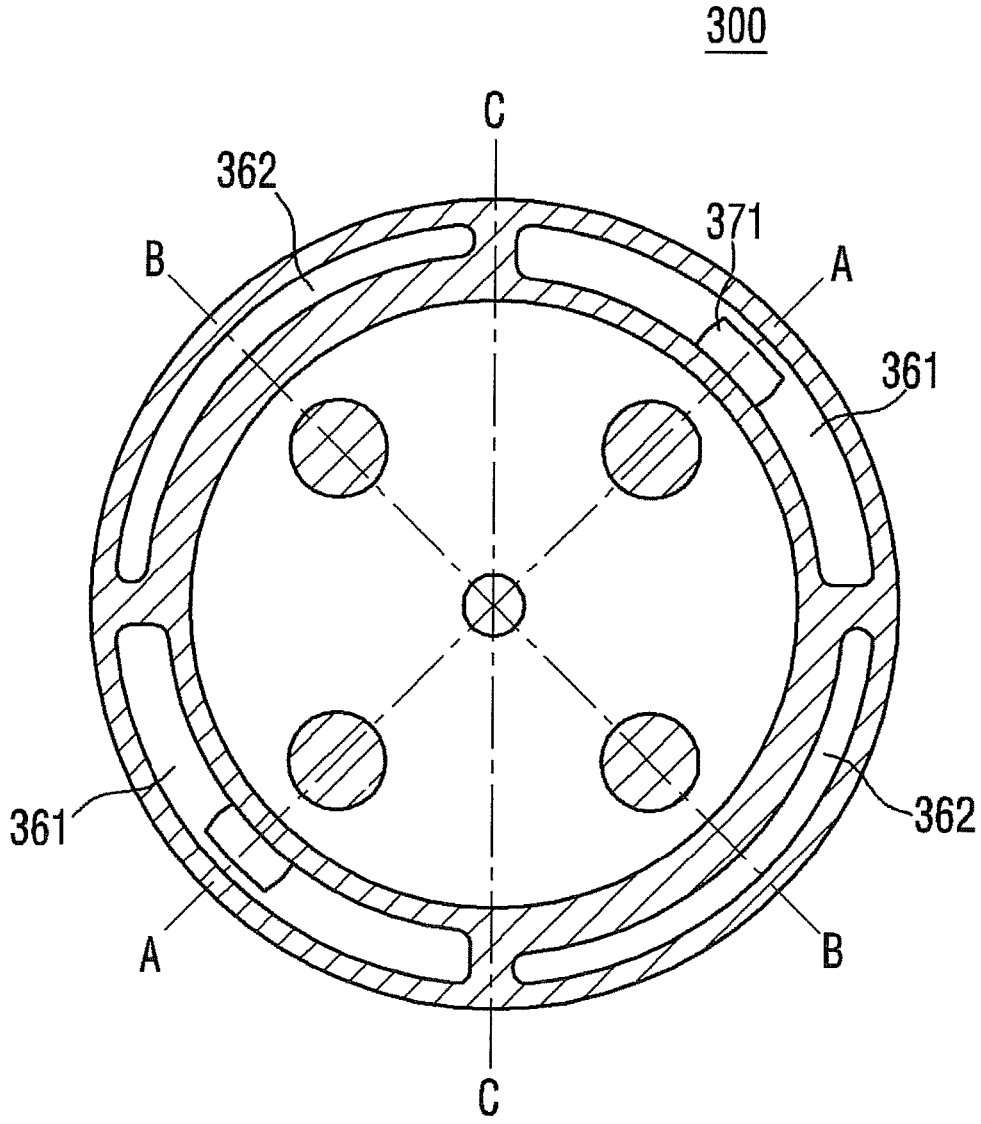

[Fig. 4]
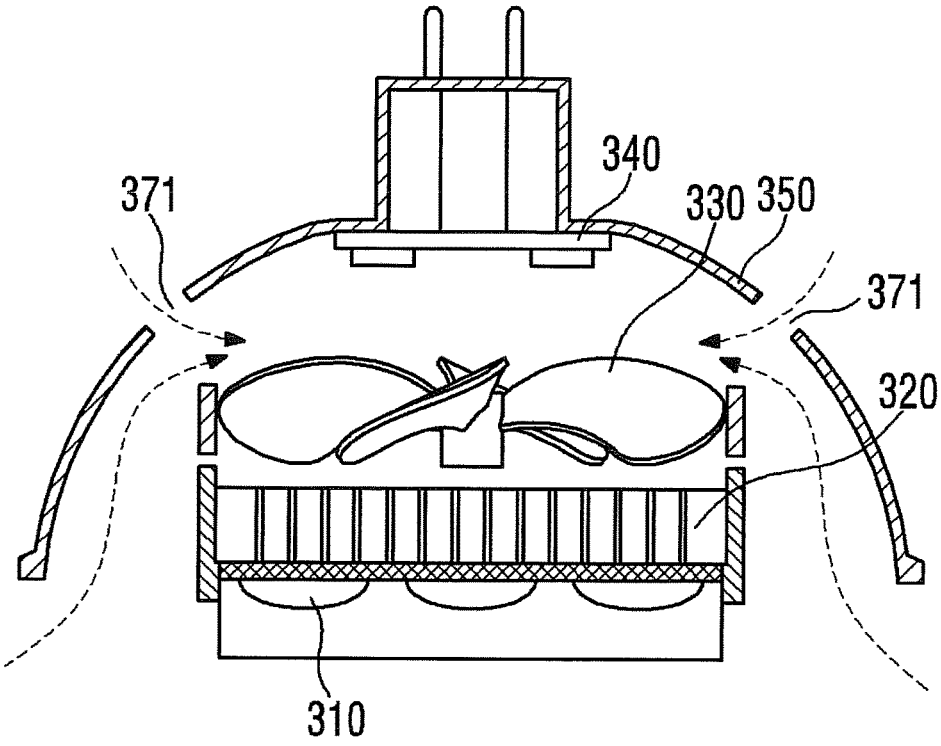
[Fig. 5]
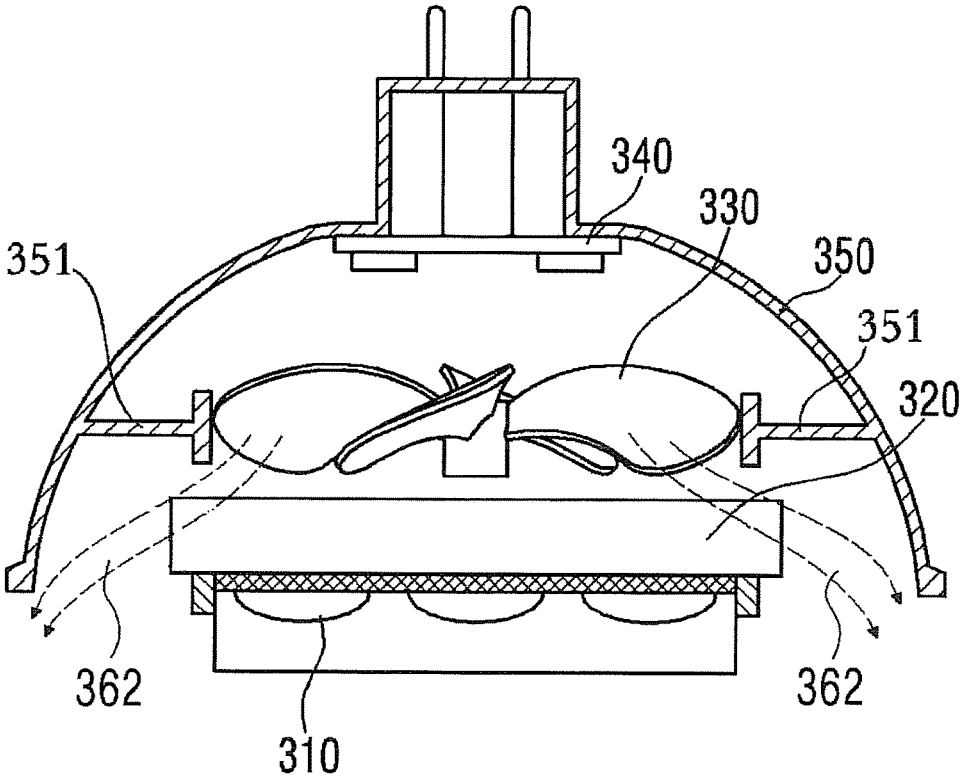

[Fig. 6]
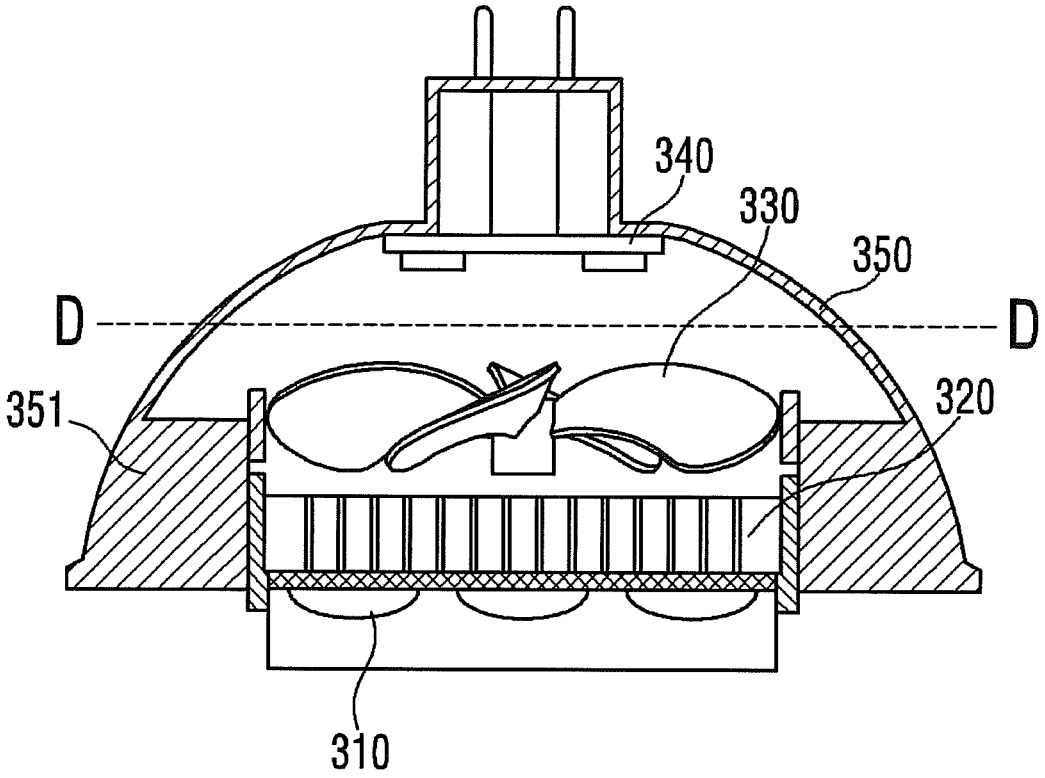

[Fig. 7]
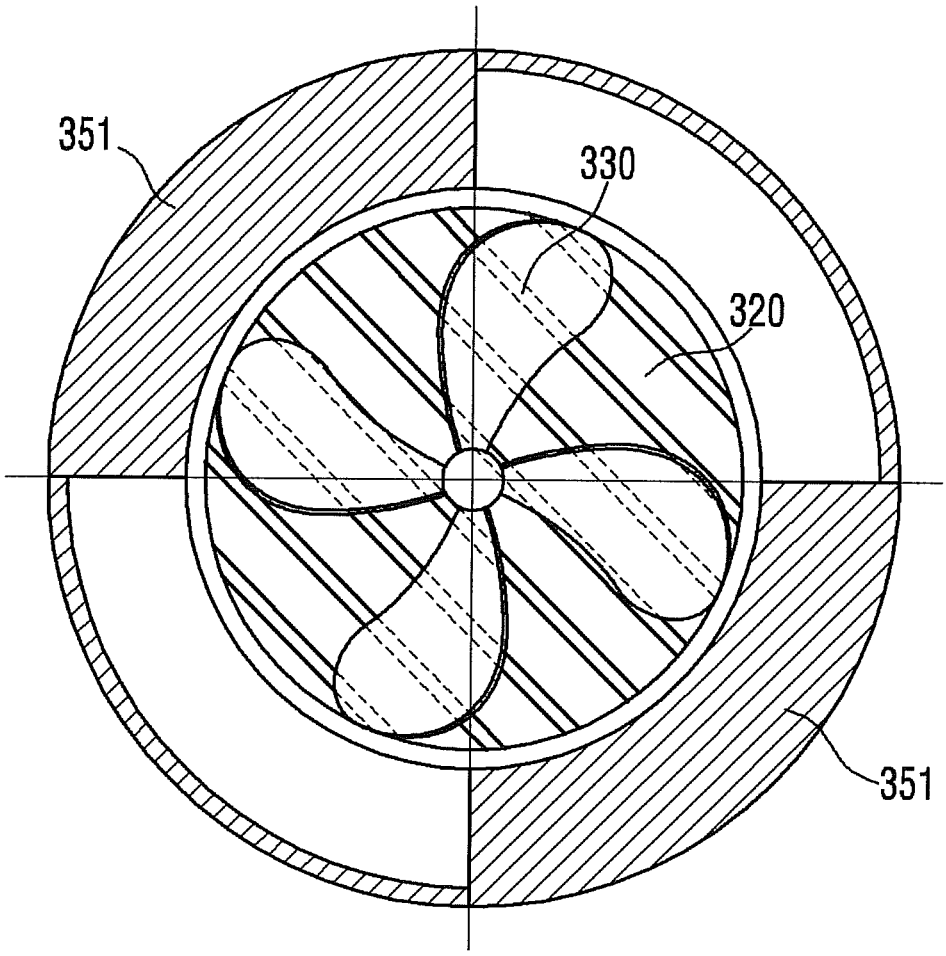

[Fig. 8]
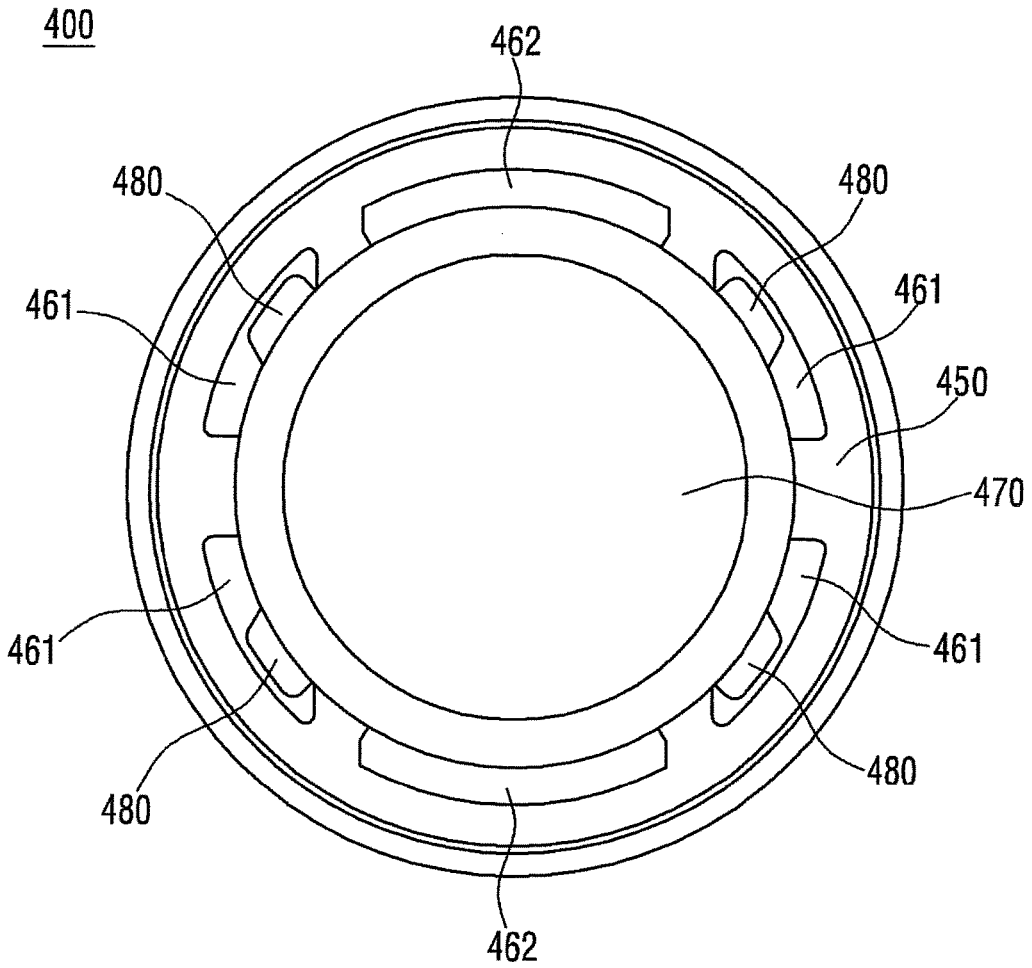

[Fig. 9]
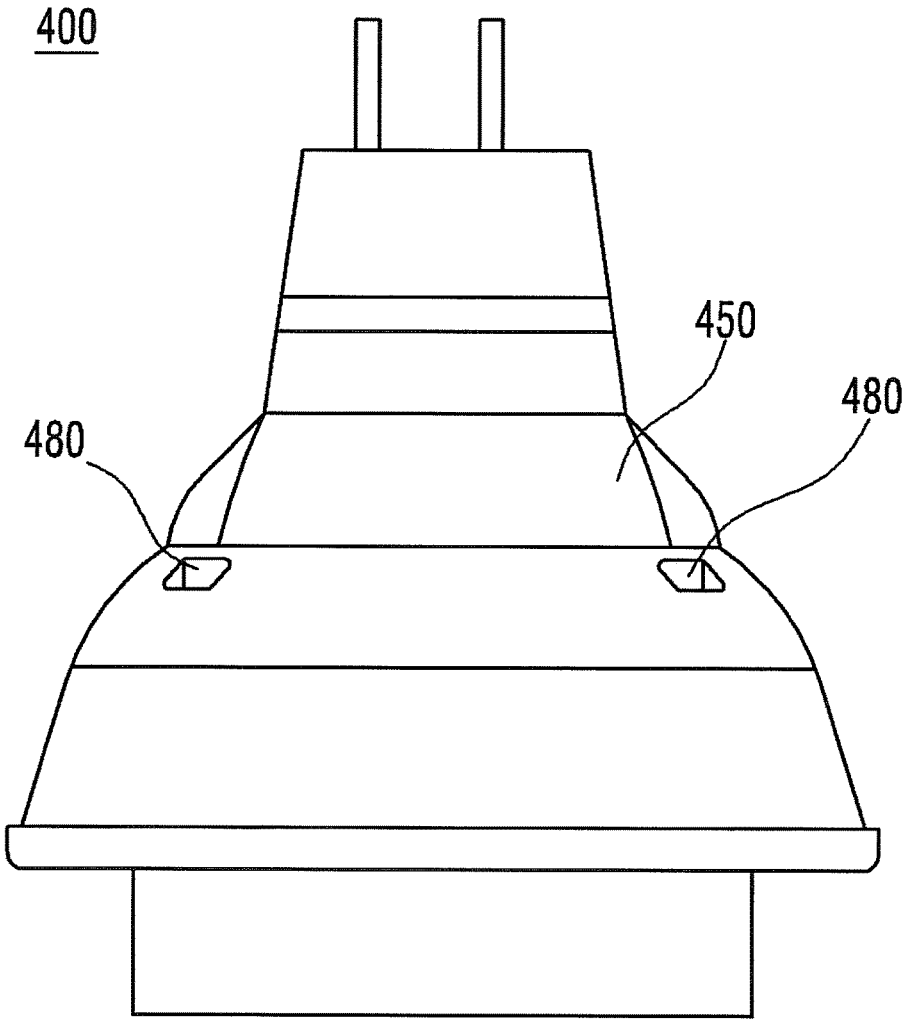
[Fig. 10a]
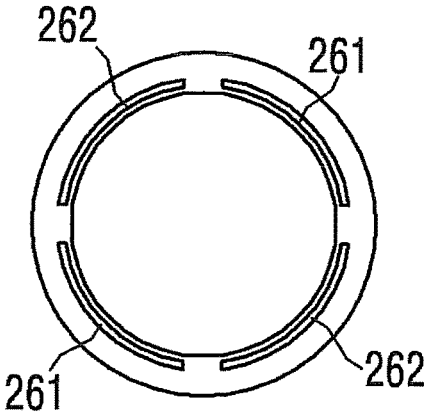

[Fig. 10b]
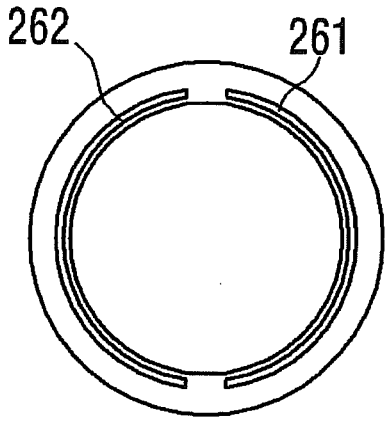
[Fig. 10c]
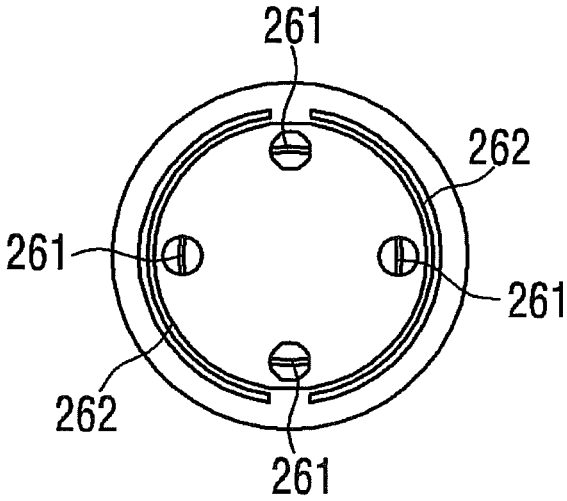
[Fig. 10d]
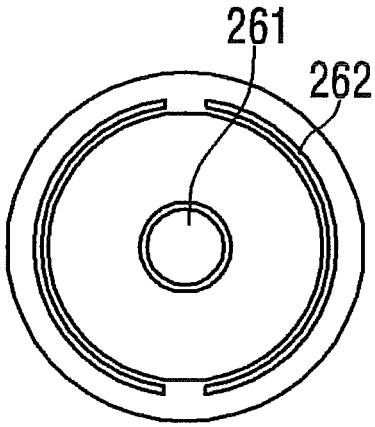

[Fig. 11]
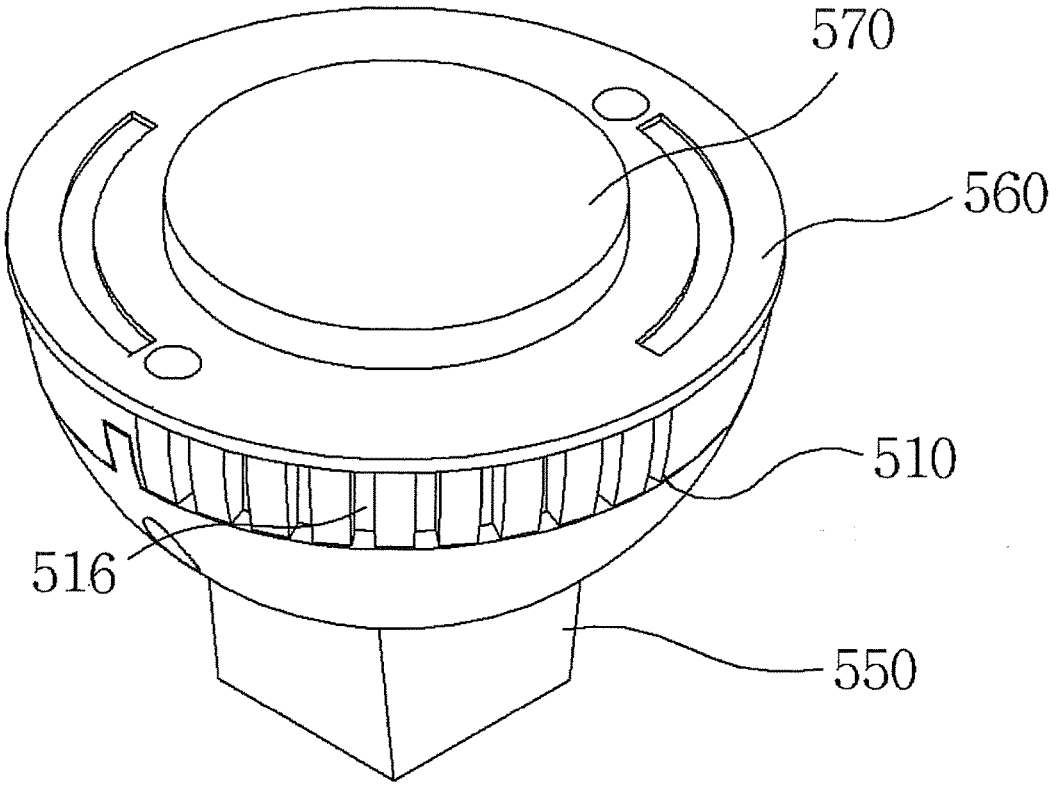

[Fig. 12]
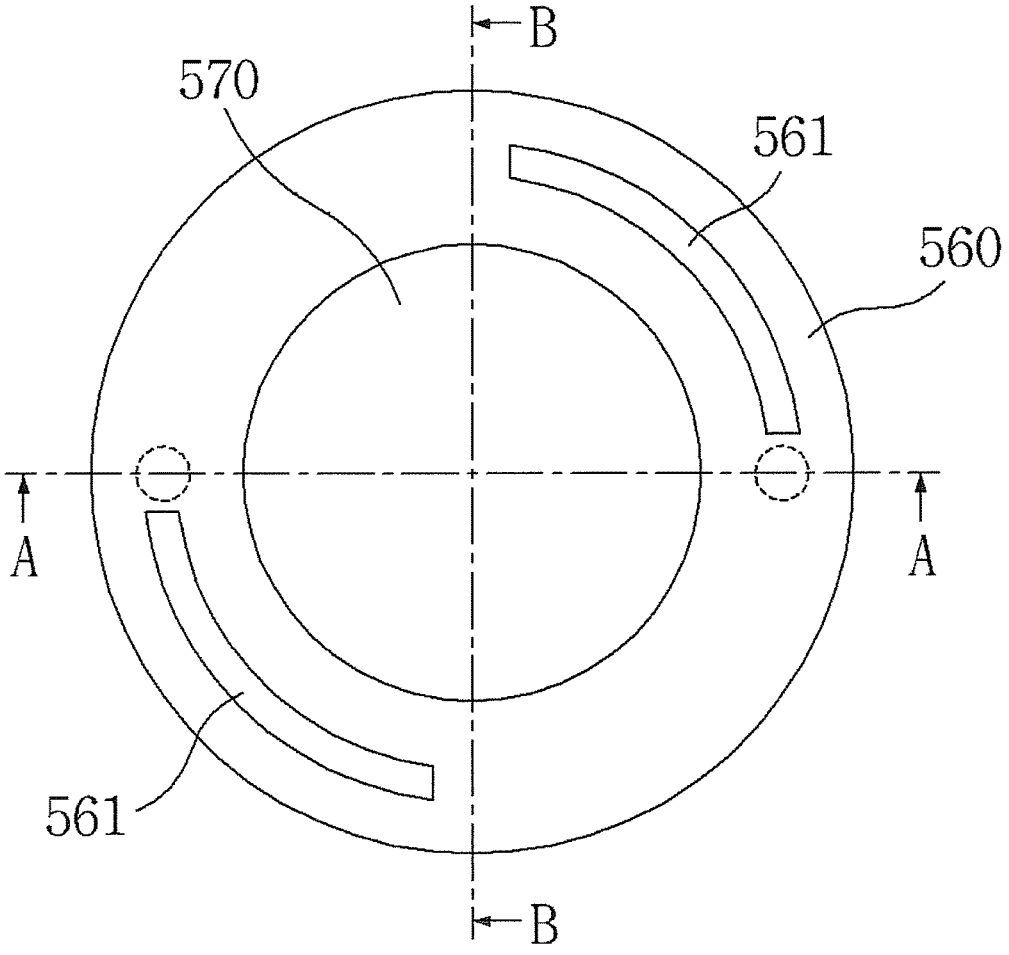

[Fig. 13]
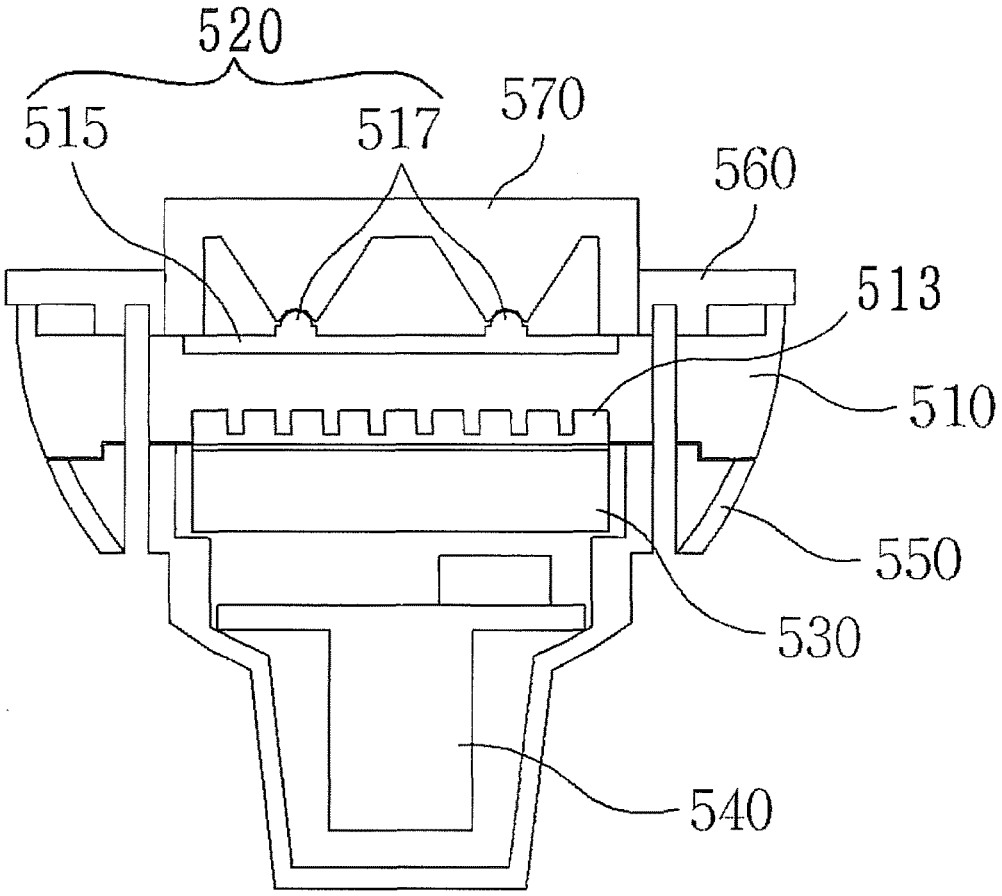

[Fig. 14]
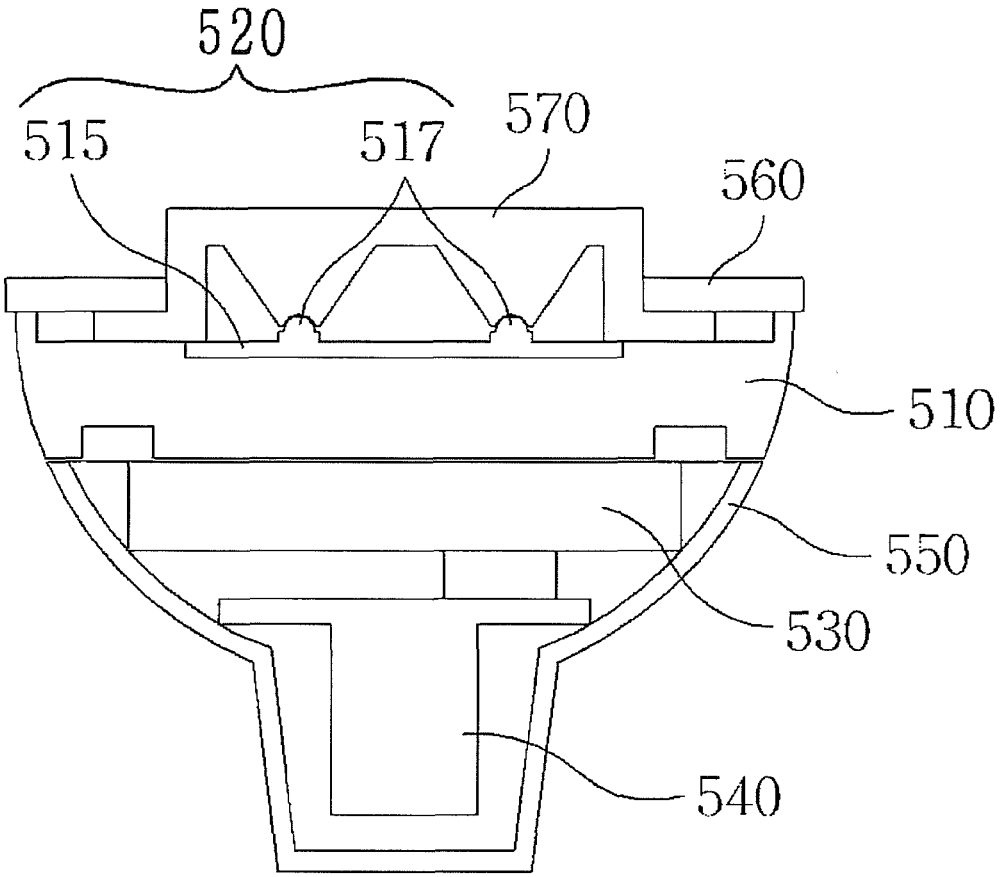

[Fig. 15]
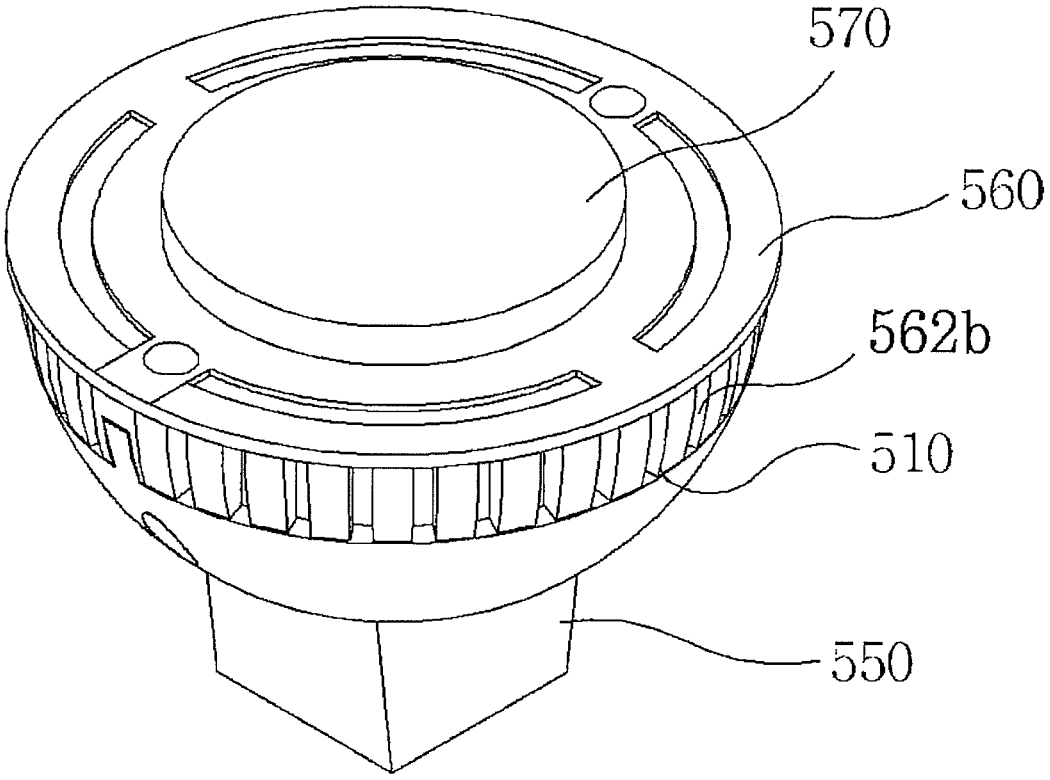

[Fig. 16]
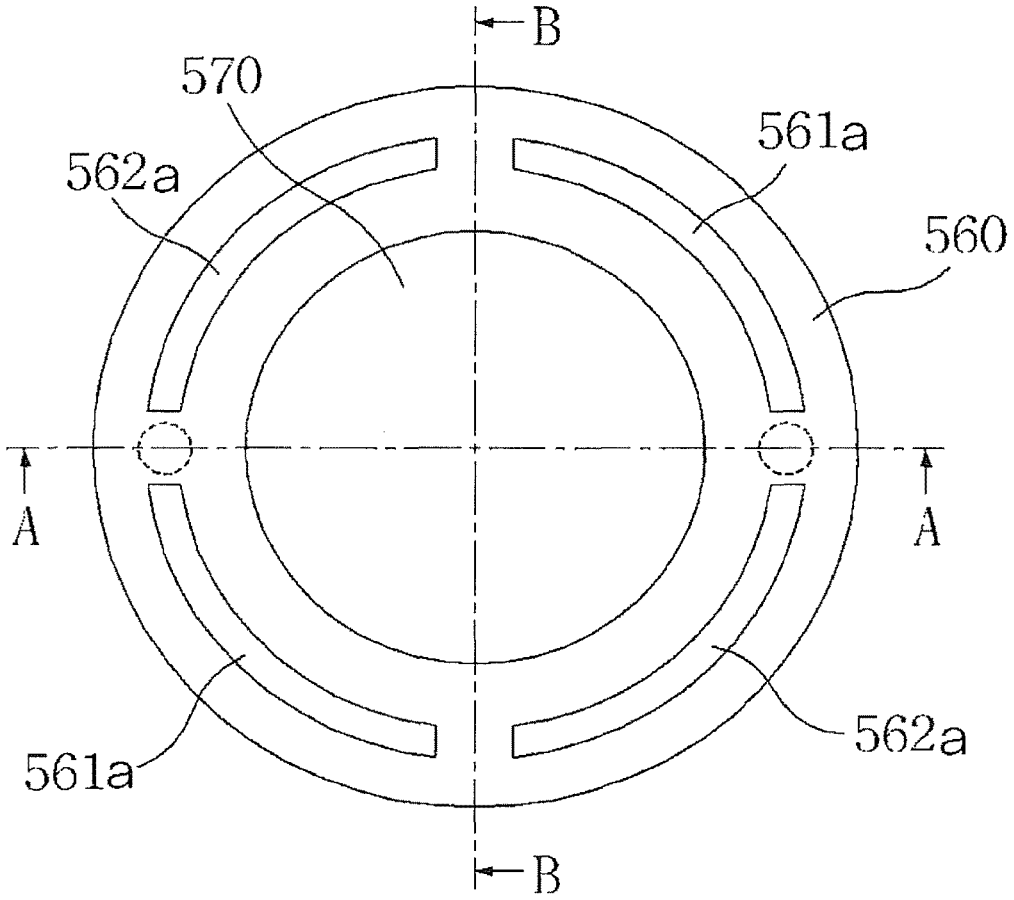
[Fig. 17a]
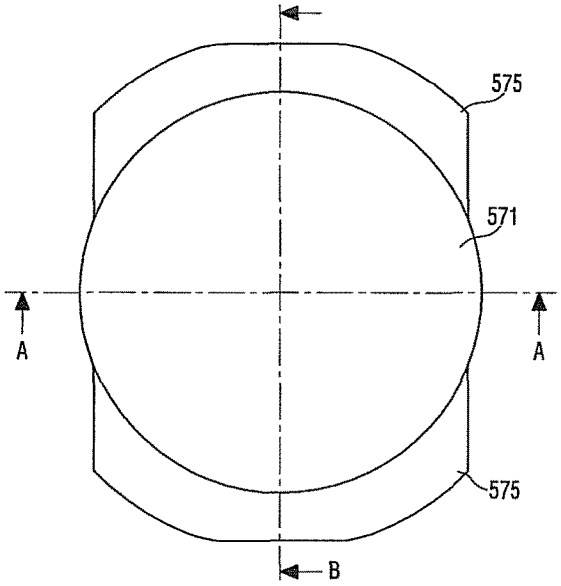

[Fig. 17b]
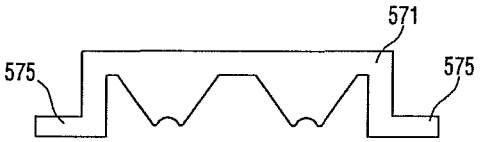
[Fig. 17c]
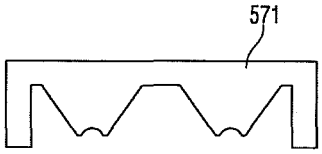

LIGHTING DEVICE

CROSS-REFERENCE TO RELATED PATENT APPLICATIONS

This application is a U.S. National Stage Application under 35 U.S.C. §371 of PCT Application No. PCT/KR2012/006920, filed Aug. 30, 2012, which claims priority to Korean Patent Application No. 10-2011-0086859, filed Aug. 30, 2011, and No. 10-2011-0091542, filed Sep. 9, 2011, whose entire disclosures are hereby incorporated by reference.

TECHNICAL FIELD

This embodiment relates to a lighting device.

BACKGROUND ART

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like.

However, the LED generates much heat when turned on. If the heat is not readily radiated, the life span and illuminance of the LED are reduced and quality characteristic is remarkably deteriorated. Therefore, advantages of the LED lighting device can be obtained under the condition that the heat radiation of the LED is easily done.

DISCLOSURE OF INVENTION

Technical Problem

The objective of the present invention is to provide a lighting device capable of overcome the above-mentioned problems and of having excellent heat radiation efficiency The objective of the present invention is to provide a lighting device such that the illuminance and life span of a light source used in the lighting device are maximized and quality characteristic is remarkably improved.

The objective of the present invention is to provide a lighting device capable of minimizing dust introduced into the device.

The objective of the present invention is to provide a lighting device of which the parts are easy to manufacture and assemble.

Solution to Problem

One embodiment is a lighting device. A lighting device includes: a light emitting module; a heat sink which is disposed on the light emitting module; a heat sink fan which is disposed over the heat sink; an upper case which covers the heat sink fan and the heat sink; and a lower case which is coupled to the upper case and fixes the light emitting module. A first air inlet is disposed in the lower case, and wherein a second air inlet is disposed in the upper case.

The lighting device further includes a middle body which is disposed between the upper case and the lower case and is disposed on the light emitting module, and wherein the middle body has a first air outlet.

The lighting device further includes a second air outlet in the lower case.

An air path connected to the first air inlet and an air path connected to the second air outlet are separated from each other by the heat sink and a partition of the upper case.

At least one of the first air inlet and the second air outlet is disposed on the circumference of the lower case.

The first air inlet is disposed closer to the center of the lower case than the second air outlet.

At least one of the first air in let the second air outlet has a circular arc shape.

The lighting device further includes a lens which is coupled to the lower case and projects in a direction in which light generated from the light emitting module is emitted.

Another embodiment is a lighting device including: a body; a light emitting module disposed on the body; a lens disposed on one side of the light emitting module: and a lower case coupled to at least a portion of the lens. The lower case is coupled to the body. A portion of the lens is disposed between the lower case and the body.

The lower case is screw-coupled to the body.

The body includes: a heat sink disposed on the other side of the light emitting module; a heat sink fan disposed apart from the heat sink; an upper case covering the heat sink and the heat sink fan.

The lens comprises an optical part allowing light generated from the light emitting module to transmit therethrough, and a fixing part extending outwardly from the optical part, and wherein the fixing part is disposed between the lower case and the body.

The lighting device further includes a middle body which is disposed between the upper case and the lower case and comprises a heat sink disposed on the light emitting module.

The middle body has a first air outlet.

The lens has a projection projecting in a direction in which light generated from the light emitting module is emitted.

A first air inlet is disposed in the lower case.

The first air inlet has a circular arc shape.

The lighting device further including a second air outlet in the lower case.

The second air outlet has a circular arc shape.

The air inlet is disposed closer to the center of the lower case than the second air outlet.

Advantageous Effects of Invention

Alighting device in accordance with the present invention is capable of remarkably improving heat radiation efficiency.

A lighting device in accordance with the present invention is capable of maximizing the illuminance and life span of a light source and of remarkably improving quality characteristic.

A buried-type lighting device which is buried in a wall or a ceiling in accordance with the present invention is capable of performing effective heat exchange with outside air.

A lighting device in accordance with the present invention is capable of minimizing dust introduced into the lighting device.

A lighting device in accordance with the present invention includes parts thereof which are easy to manufacture and assemble.

BRIEF DESCRIPTION OF DRAWINGS

FIG. 1 is a sectional perspective view of a lighting device according to a first embodiment;

FIG. 2 shows a heat sink fan of the lighting device according to the first embodiment;

FIG. 3 is a lower plan view of a lighting device according to a second embodiment;

FIG. 4 is a cross sectional view of FIG. 3 taken along line A-A;

FIG. 5 is a cross sectional view of FIG. 3 taken along line B-B;

FIG. 6 is a cross sectional view of FIG. 3 taken along line C-C;

FIG. 7 is a plan view of FIG. 3 taken along line D-D;

FIG. 8 is a lower plan view of a lighting device according to a third embodiment;

FIG. 9 is a side view of the lighting device according to the third embodiment; embodiment;

FIG. 10 shows various embodiments of arrangement of an air inlet and air outlet of the lighting device;

FIG. 11 is a perspective view of a lighting device according to a fourth embodiment;

FIG. 12 is a lower plan view of the lighting device according to the fourth embodiment;

FIG. 13 is a cross sectional view of FIG. 12 taken along line A-A;

FIG. 14 is a cross sectional view of FIG. 12 taken along line B-B;

FIG. 15 is a perspective view of a lighting device according to a fifth embodiment;

FIG. 16 is a lower plan view of the lighting device according to the fifth embodiment; and FIG. 17 is a view showing a lens of the lighting device according to the fifth embodiment.

MODE FOR THE INVENTION

Hereafter, embodiments of the present invention will be described in detail with reference to the accompanying drawings. However, the accompanied drawings are provided only for more easily describing the present invention. It is easily understood by those skilled in the art that the spirit and scope of the present invention is not limited to the scope of the accompanied drawings.

A criterion for "on" and "under" of each layer will be described based on the drawings. A thickness or a size of each layer may be magnified, omitted or schematically shown for the purpose of convenience and clearness of description. The size of each component may not necessarily mean its actual size.

In description of embodiments of the present invention, when it is mentioned that an element is formed "on" or "under" another element, it means that the mention includes a case where two elements are formed directly contacting with each other or are formed such that at least one separate element is interposed between the two elements. The "on" and "under" will be described to include the upward and downward directions based on one element.

FIG. 1 is a sectional perspective view of a lighting device according to a first embodiment.

Referring to FIG. 1, a lighting device 100 may include a light emitting module 110, a heat sink 120, a heat sink fan 130, an upper case 150, a driving part 140 and a lower case 160. The heat sink 120 is attached and fixed to the light emitting module 110 and includes heat sink plates formed on the outer circumference thereof. The heat sink fan 130 is disposed over the heat sink 120. The upper case 150 covers the heat sink fan 130. The driving part 140 is disposed within the upper case 150 and is electrically connected to and supplies electric power to the heat sink fan 130 and an LED mounting substrate 112. The lower case 160 is attached and fixed to the upper case 150 and fixes the light emitting module 110.

Respective components will be described in detail.

<Light Emitting Module>

The light emitting module 110 may include at least one LED 111 and the LED mounting substrate 112 on which the at least one LED 111 is mounted. A plurality of the LEDs 111 may be mounted on the LED mounting substrate 112. The number and arrangement of the LEDs 111 can be freely controlled according to required illuminance. The light emitting module 110 may be formed in the form of a plurality of the collected LEDs in order to be easy to handle and to be suitable to produce.

The LED mounting substrate 112 may be formed by printing a circuit pattern on an insulator. For example, the LED mounting substrate 112 may include a common printed circuit board (PCB), a metal core PCB, a flexible PCB, a ceramic PCB and the like. Also, the LED mounting substrate 112 may include a chips on board (COB) allowing an unpackaged LED chip to be directly bonded to a printed circuit board. The LED mounting substrate 112 may be formed of a material capable of efficiently reflecting light. The surface of the LED mounting substrate 112 may have a color such as white, silver and the like capable of efficiently reflecting light.

The LED 111 mounted on the substrate may be a red LED, a green LED, a blue LED or a white LED, each of which emits red, green, blue or white light, respectively. However, there is no limit to the kind and number thereof.

<Heat Sink>

The heat sink 120 is disposed on the light emitting module 110. The heat sink 120 may receive heat generated from the light emitting module 110 and radiate the heat.

A plurality of heat radiating fins may be formed on the surface of the heat sink 120. The plurality of heat radiating fins may be radially along the surface of the heat sink 120. The shape of the heat sink 120 increases the surface area thereof, thereby improving heat radiation efficiency of the heat sink 120.

Regarding a relation between the heat sink fan 130 and the lower case 160, which are described below, the heat sink 120 may include the heat radiating fins which are arranged in a certain direction in such a manner that air injected into the heat sink 120 through the heat sink fan 130 passes the surface of the heat sink 120 and is emitted through an air outlet of the lower case 160. For example, the heat radiating fins of the heat sink 120 may be disposed perpendicular to the direction of the air injected from the heat sink fan 130 and may be arranged toward the air outlet of the lower case 160.

The heat sink 120 may be formed of a metallic material or a resin material, each of which has excellent heat radiation efficiency. However, there is no limit to the material of the heat sink 120. For example, the material of the heat sink 120 may include at least one of Al, Ni, Cu, Ag and Sn.

Though not shown in the drawing, a heat radiating plate may be disposed between the light emitting module 110 and the heat sink 120. The heat radiating plate may include a thermal conduction silicon pad, a thermal conductive tape or the like which has a high thermal conductivity. The heat radiating plate is able to effectively transfer the heat generated from the light emitting module 110 to the heat sink 120.

<Heat Sink Fan>

FIG. 2 shows the heat sink fan 130 of the lighting device 100 according to the first embodiment.

Referring to FIG. 2, the heat sink fan 130 is disposed over the heat sink 120 and causes forcibly convection of outside air within the lighting device 100. Therefore, the heat sink fan 130 is able to perform a function of cooling the inside of the lighting device 100.

When electric power is applied to the lighting device 100 and the light emitting module 110 emits light, the lighting device 100 generates much heat. Therefore, electric power is applied to the heat sink fan 130 simultaneously when the electric power is applied. Then, the heat sink fan 130 can work. Otherwise, it is also possible that only when the temperature of the inside of the lighting device 100 is higher than a certain temperature, the heat sink fan 130 is allowed to work by a thermal sensor within the lighting device 100.

When the heat sink fan 130 starts to work, the outside air is inhaled through an air inlet to be described below of the lower case 160, and then the inhaled air performs heat exchange while passing the heat sink fan 130 and heat sink 120. The heated air may be emitted outward through the air outlet of the lower case 160.

Specifically, the lighting device 100 may be MR16. The outer diameter of the MR16 may be 50 mm and the diameter of the heat sink fan 130 may be 30 mm. Since the width of the hemispherical MR16 increases with the approach to the lower portion thereof, the heat sink 120 may have a maximum size for the heat radiation and may have a diameter larger than that of the heat sink fan 130.

As a result, the heat sink fan 130 may directly inject the air to some areas of the heat sink 120. However, as mentioned in the description of the heat sink 120, the arrangement of the heat radiating fins may be specified such that the injected air passes the entire surface of the heat sink 120.

The heat sink fan 130 may have, as shown in FIG. 2, a bolt insertion hole 131 which is formed on outer surface thereof and allows the heat sink fan 130 to be coupled to the upper case 150 to be described below.

<Upper Case and Lower Case>

The upper case 150 covers the outside of the heat sink fan 130 and is coupled to the lower case 160. Further, the upper case 150 may include an air path along which the air introduced into the lighting device 100 is emitted.

A terminal 141 for supplying electric power may be disposed on the outside of the upper case 150. An air inlet (not shown) for air introduction may be disposed in the top surface of the upper case 150.

The driving part 140 may be disposed within the upper case 150. The driving part 140 is electrically connected to the heat sink fan 130 and the light emitting module 110, and supplies electric power supplied from the terminal 141 to the heat sink fan 130 and the light emitting module 110.

The driving part 140 may be formed by mounting various electronic components for driving the LED on the PCB. Here, the terminal 141 is formed on the top surface of the PCB. The terminal 141 penetrates a rear cover and is partially exposed upward. Then, the terminal 141 may be coupled and electrically connected to a terminal coupling recess by using the exposed portion of the terminal 141.

The terminal 141 of the exposed portion may be formed in the form of a pin exposed to the rear end of the upper case 150 (shown with two terminals in the drawing). However, the shape of the terminal 141 is not limited to this. The terminal 141 functions as an entrance for receiving an electric power from an external power supply (a DC power supply is assumed, however, the terminal 141 may accept an AC power supply and include either a rectifier or a condenser disposed therein) to the lighting device of the present invention.

The upper case 150, the heat sink fan 130 and the lower case 160 include a bolt insertion hole 151. After the components, i.e., the lower case 160, the heat sink fan 130, the heat sink 120, the light emitting module 110 and the like are assembled without fastening, the upper case 150 is covered on the components and the respective components are fixed and coupled.

When the components are coupled, the lower case 160 may hold the outer portion of the light emitting module 110 and fix the light emitting module 110 together with the other components. Also, a space for receiving the light emitting module 110 is formed in the lower case 160, so that the light emitting module 110 may be disposed in the receiving space of the lower case 160.

The lower case 160 may include an air inlet and an air outlet which are formed toward an illumination area of the lighting device 100. The air inlet and the air outlet are configured and disposed independently of each other. The air inlet may be used to allow external air to be introduced into the lighting device 100. The air outlet may be used to allow the air processed by the heat exchange within the lighting device 100 to be emitted therethrough.

Regarding the air path of the lighting device 100, the air outside the lighting device 100 is introduced into a space between the upper case 150 and the upper portion of the heat sink fan 130 through the air inlet of the lower case 160, and then is inhaled into the heat sink fan 130 by the operation of the heat sink fan 130 and is injected into the space between the heat sink 120 and the lower portion of the heat sink fan 130. The injected air cools the heat sink 120 by exchanging the heat with the heat sink 120 while passing the surface of the heat sink 120. Then the air is emitted through the air outlet of the lower case 160.

The upper case 150 or the lower case 160 may include a partition in order to distinguish between the air introduction path through the air inlet and the air emission path through the air outlet.

When the lighting device 100 is used buried in a wall or a ceiling, since the air inlet and the air outlet are not placed in a buried portion of the lighting device 100 but placed in externally exposed portion of the lighting device 100, the external air can be effectively introduced and emitted.

A lens 170 may be disposed in the lower case 160. The lens 170 may be formed over each of the LEDs. The lens 170 may collect light emitted from the LEDs or disperse and focus the light at a predetermined angle. The lens 170 provides light having a desired shape by dispersing and focusing the light and protects the LEDs from impact.

FIG. 3 is a lower plan view of a lighting device 300 according to a second embodiment. The lower plan view of the lighting device 300 of FIG. 3 may be used as a lower plan view of the lighting device 100 of FIG. 1. FIG. 4 is a cross sectional view of FIG. 3 taken along line A-A.

Referring to FIGS. 3 and 4, the lighting device 300 may include a light emitting module 310, a heat sink 320 disposed on the light emitting module 310, a heat sink fan 330 disposed over the heat sink 320, and a housing 350 receiving the light emitting module 310, the heat sink 320 and the heat sink fan 330.

While the light emitting module 310, the heat sink 320 and the heat sink fan 330 are the same as those of the lighting device 100 shown in FIG. 1, the lighting device shown in FIGS. 3 and 4 includes the housing 350 receiving the light emitting module 310, the heat sink 320 and the heat sink fan 330. The housing 350 may be, as shown in FIG. 1, divided into the upper case 150 and the lower case 160 or may be integrally formed.

A driving part 340 is disposed within the housing 350 and supplies external electric power to the heat sink fan 330 and the light emitting module 310.

An air inlet 361 and an air outlet 362 may be formed in the lower portion of the housing 350, that is to say, a portion of the housing 350, through which light is emitted from the light emitting module 310. An air path may be formed in the housing 350 in such a manner that the air introduced from the air inlet 361 passes the heat sink fan 330, and then passes the heat sink 320 and is emitted through the air outlet 362. The air path connected to the air inlet 361 and the air outlet 362 may be separated from each other by the heat sink fan 330 and a partition 351 within the housing 350.

An upper air inlet 371 is formed in the upper surface of the housing 350, which belongs to the area of the heat sink fan 330. The upper air inlet 371 may be disposed perpendicularly corresponding to the air inlet 361 formed in the lower surface of the housing 350.

Therefore, as shown in FIG. 3, In the bottom plan view of the lighting device 700, the upper air inlet 371 formed in the upper surface of the housing 350 can be seen through the air inlet 361 formed in the lower surface of the housing 350.

In FIG. 4, shown is an air introduction path of the lighting device 300. Due to the operation of a heat sink fan 330, the air outside the lighting device 300 passes through the air inlet 361 and the upper air inlet 371, and moves to a space between the housing 350 and the upper portion of the heat sink fan 330.

According to the embodiment shown in FIG. 1, when the heat sink fan 130 is operated, the outside air would move to a space between the upper case 150 and the upper portion of the heat sink fan 130.

Regarding the cross sectional view in the direction of the air inlet 361, the heat sink 320 may be separated from the air introduction path. As a result, the air introduced from the air inlet 361 and the upper air inlet 371 maintains its temperature to be a normal temperature without contact with the heat sink 320 and is introduced into the lighting device.

If the introduced air first contacts with the heat sink, heated air is introduced into the space between the housing and the upper portion of the heat sink fan, so that the driving part 340 may not be effectively cooled.

The introduced air is maintained to have a normal temperature and is moved to the space between the housing 350 and the upper portion of the heat sink fan 330. Then, the driving part 340 can be cooled through the heat exchange between the air and the driving part 340 of the lighting device 300.

FIG. 5 is a cross sectional view of FIG. 3 taken along line B-B.

Referring to FIG. 5, shown is an air emission path of the lighting device 300. As shown in FIG. 4, the air introduced from the air inlet 361 and the upper air inlet 371 into the upper portion of the heat sink fan 330 is injected into a space between the heat sink 320 and the lower portion of the heat sink fan 330 by the operation of the heat sink fan 330. The injected air passes the surface of the heat sink 320 and exchanges heat with the heat sink 320, thereby cooling the heat sink 320 which has received the heat from the light emitting module 310.

The inside of the housing 350, which belongs to the area to the air outlet 362, is, as shown in FIG. 5, blocked by the partition 351. Therefore, the air heated by the heat sink 320 does not come into the lighting device 300 again and is emitted to the outside of the lighting device 300 by the operation of the heat sink fan 330.

FIG. 6 is a cross sectional view of FIG. 3 taken along line C-C.

FIG. 7 is a plan view of FIG. 3 taken along line D-D.

FIGS. 6 and 7 are a cross sectional view and a plan view which show the partition 351 of the lighting device 300. Provided is the partition 351 which separates the air inlet 361, the air outlet 362 and the air path connected to them.

FIG. 8 is a lower plan view of a lighting device 400 according to a third embodiment. The lighting device 400 includes the same components as those of the lighting device 300 shown in FIG. 3. However, arrangements of the air inlet and the air outlet are different from those of the lighting device 300. Therefore, the air inlet and the air outlet will be described below.

A lens 470, an air inlet 461 and an air outlet 462 may be disposed in the lower portion of a housing 450, that is to say, a portion of the housing 450, through which light is emitted from the light emitting module. The lighting device 400 includes four air inlets 461 formed in the bottom surface of the housing 450 and two air outlets 462.

An upper air inlet 480 may be formed in the top surface of the housing 450, i.e., the surface of the housing 450, which corresponds to the upper portion of the heat sink fan. The upper air inlet 480 may be disposed perpendicularly corresponding to the position of the air inlet 461 formed in the bottom surface of the housing 450.

Therefore, in the lower plan view of lighting device 400 shown in FIG. 8, the upper air inlet 480 formed in the top surface of the housing 450 can be seen through the air inlet 461 formed in the bottom surface of the housing 450.

FIG. 9 is a side view of the lighting device 400 according to the third embodiment; embodiment.

As shown in FIG. 9, the upper air inlet 480 may be formed in the top surface of the housing 450. Since the upper air inlet 480 is formed in addition to the air inlet 461 formed in the bottom surface of the housing 450, dust introduction is minimized by reducing an air introduction rate, and cooling effect of internal temperature of the lighting device is enhanced by increasing the amount of the air introduced at a normal temperature.

FIG. 10 shows various embodiments of arrangement of an air inlet and air outlet of the lighting device.

As shown in FIG. 10, an air inlet 261 and an air outlet 262 may have various shapes and may be disposed in the lower surface of the housing or in various positions of the lower case.

As shown in (a) and (b) of FIG. 10, the air inlet 261 and the air outlet 262 may be formed on the circumference of the lower case in the form of a circular arc. In (a) of FIG. 10, shown is a case where the air inlet 261 and the air outlet 262 are alternately formed on the circumference of the lower case. The circumference of the lower case means the edge of the lower case, which is far from the center of the lower case. How far the air inlet 261 and the air outlet 262 are formed from the center of the lower case may be freely determined depending on the type of the embodiment of the present invention. As shown in (a) and (b) of FIG. 10, the air inlet 261 and the air outlet 262 may be formed in the form of a circular arc forming a concentric circle with the circular lower case.

As shown in (c) of FIG. 10, the air inlet 261 may be disposed closer to the center of the lower case than the air outlet 262. As shown in (d) of FIG. 10, the air inlet 261 may be disposed at the center of the lower case and the air outlet 262 may be disposed on the circumference of the lower case.

The air inlet 261 and the air outlet 262 may have various shapes such as a circle, a polygon and the like as well as the circular arc.

As shown in (c) and (d) of FIG. 10, when the air inlet 261 is disposed more inside than the air outlet 262, it is possible to reduce a probability that the heated air emitted through the air outlet 262 is reintroduced through the air inlet 261.

The following Table 1 shows a simulation result of an LED temperature and a case temperature in an MR16 lighting device with an atmosphere temperature of 25° C. and an applied power of 10 W. A case where only the heat sink is used is compared with cases of embodiments (a) to (d) including the air inlet and the air outlet and using the heat sink fan.

TABLE 1

| | LED temperature [° C.] | Case temperature [° C.] | Remark |
|---|---|---|---|
| Existing (heat sink only) | 161.7 | 66.4 | Atmosphere temperature: 25° C. Applied power: 10 W |
| Embodiment (a) | 145.1 | 75.1 | |
| Embodiment (b) | 146.8 | 66.5 | |
| Embodiment (c) | 129.0 | 81.2 | |
| Embodiment (d) | 140.3 | 94.8 | |

Compared with the case where only the heat sink is used, it can be seen that in the case where the heat sink fan is also used, the case temperature rises by 0.1° C. to 28° C., however, the LED temperature falls by 16° C. to 32° C.

The following Table 2 shows a result that an internal temperature in a case where the upper air inlet is disposed in the housing or the top surface of the upper case and an internal temperature in a case where not disposed are tested at a normal temperature of 25° C.

TABLE 2

| Test Point Temp. (° C.) | | | |
|---|---|---|---|
| | Case | C. | Remark |
| Case 1 | No Top cover Hole | 89.5 | Based on a normal temperature of 25° C. |
| Case 2 | Top cover Hole | 86.6 | |

As shown in Table 2, the internal temperature of the lighting device in the case where the upper air inlet is disposed becomes lower.

Considering that the quality characteristic and life span of the LED is affected by the temperature of the LED, the lighting device according to the embodiments of the present invention shows remarkably improved quality characteristic and life span as compared with those of a prior lighting device which uses only the heat sink.

The lighting devices according to the embodiments described above include not only the heat sink and heat sink fan, but also the air inlet and the air outlet which are disposed independently of each other. The housing of the lighting devices includes the additional upper air inlet disposed in the top surface of the housing. Accordingly, the cooling efficiency of the lighting device is improved.

The upper air inlet is additionally disposed in the top surface of the housing as well as the bottom surface of the housing, so that dust introduction is minimized by reducing an air introduction rate. Further, air having a lower temperature is introduced into the top surface, so that the life spans of the driving part and the fan may become longer.

The lighting device according to the embodiment may be used in a lighting lamp which emits light by collecting a plurality of LEDs. Particularly, the lighting device may be used as a buried-type lighting device. The buried-type lighting device is installed in a structure which is buried in a wall or a ceiling and faces toward an illumination area, and uses the LED which is installed in the structure such that only the front of the LED is exposed.

[A Modified Example of Forming an Air Outlet in a Peripheral Portion]

FIG. 11 is a perspective view of a lighting device according to a fourth embodiment. FIG. 12 is a lower plan view of the lighting device according to the fourth embodiment. FIG. 13 is a cross sectional view of FIG. 12 taken along line A-A. FIG. 14 is a cross sectional view of FIG. 12 taken along line B-B.

Referring to FIGS. 11 to 14, the lighting device may include a light emitting module 520, a middle body 510 disposed on the light emitting module 520, an upper case 550 coupled to the middle body 510, and a lower case 560 which is coupled to the middle body 510 and fixes the light emitting module 520.

The light emitting module 520 may include a substrate 515 and a light emitting device 517 disposed on the substrate 515.

The middle body 510 may include a heat sink 513 disposed on one side of the light emitting module 520. The middle body 510 is disposed contacting with the rear portion of the light emitting module 520, so that heat generated from the light emitting module 520 can be efficiently transferred to the middle body 510.

A heat sink fan 530 is disposed on the heat sink 513, thereby transferring outside air flow to the heat sink 513. Due to the air flow, heat from the heat sink 513 may be radiated to the outside. The heat sink fan 530 may be spaced apart from and disposed toward the heat sink 513.

The upper case 550 may be disposed to cover the heat sink fan 530. The upper case 550 may form a confined space allowing the outside air inhaled by the heat sink fan 530 to be emitted through an air outlet 516.

The lower case 560 may have, as shown in FIG. 12, an air inlet 561. A circular dotted line through which a line A-A passes is marked on the surface of the lower case 560 shown in FIG. 12. The circular dotted line is a screw recess used to screw couple the lower case 560 to the middle body 510 and the like.

The position of the air inlet 561 disposed on the lower case 560 is changeable. As shown in FIG. 12, the air inlet 561 may be disposed on the circumference of the lower case 560 or may be disposed at the center of the lower case 560.

The air outlet 516 may be disposed on the middle body 510 in the direction of the side where the air inlet 561 of the lower case 560 is not disposed. As described above, the air introduced through the air inlet 561 comes into a space between the upper case 550 and the heat sink fan 530 and passes the heat sink fan 530. Then, the air exchanges the heat with the heat sink 513 and is emitted through the air outlet 516.

The air inlet 561 of the lower case 560 may be connected to a space between the upper case 550 and the upper portion of the heat sink fan 530. The air outlet 516 may be connected to a space between the heat sink 513 and the lower portion of the heat sink fan 530.

Also, an air path connected to the air inlet 561 and an air path connected to the air outlet 516 may be separated from each other by the heat sink fan 530 and a partition of the upper case 550.

The air outlet 516 is disposed on a side toward the outer circumference of the middle body 510 and allows the introduced air to be emitted in the direction of the outer circumference of the lighting device. In this case, the air emitted through the air outlet 516 is not introduced into the air inlet 561 again. Therefore, the air heated by the heat exchange with the heat sink 513 is not introduced into the lighting device again, thereby improving thermal efficiency.

Also, the lower case 560 may further include a lens 570. The lens 570 projects in a direction in which the light generated from the light emitting module is emitted. The lens 570 projects higher than the lower case 560.

[A Modified Example of a Lens Which is Easy to Couple]

FIG. 15 is a perspective view of a lighting device according to a fifth embodiment. FIG. 16 is a lower plan view of the lighting device according to the fifth embodiment. FIG. 17 is a view showing a lens of the lighting device according to the fifth embodiment.

Referring to FIGS. 15 to 17, like the lighting device shown in FIGS. 11 to 14, the lighting device may further include a light emitting module (not shown), the middle body 510, a heat sink fan (not shown), a driving part (not shown), the upper case 550 and the lower case 560. Here, the lighting device according to the fifth embodiment shown in FIGS. 15 to 17 may further include a lens 570. The lower case 560 can fix the lens 570. Also, an air inlet 561*a* and an air outlet 562*a* may be disposed in the lower case 560.

A circular dotted line through which a line A-A passes is marked on the surface of the lower case 560 shown in FIG. 16. The circular dotted line is a screw recess used to screw couple the lower case 560 to the middle body 510 and the like. Unlike the air outlet 516 formed in the middle body 510 shown in FIG. 11, the air outlet 562*a* formed in the middle body 510 shown in FIG. 15 may be formed in the entire middle body 510. The middle body 510 may not necessarily have the air outlet 562*b*. The middle body 510, the upper case 550 and the heat sink fan positioned within the middle body 510 and the upper case 550 may be designated altogether as a body.

The lens 570 may be disposed to cover the other side of the light emitting module, which is opposite to the portion in which the middle body 510 is disposed. The lens 570 projects in a direction in which light generated from the light emitting module is emitted. The lens 570 projects higher than the lower case 560. The lens 570 isn't limited to the fifth embodiment.

Referring to FIG. 17, the lens 570 may include an optical part 571 and a fixing part 575. The optical part 571 allows the light generated from the light emitting module to transmit therethrough. The fixing part 575 is disposed to extend outwardly from the optical part 571. The plan view of the lens 570 shown in (a) of FIG. 17. The cross sectional view taken along line A-A of (a) of FIG. 17 is shown in (b) of FIG. 17. The cross sectional view taken along line B-B of (a) of FIG. 17 is shown in (c) of FIG. 17.

As shown in FIG. 17, the lens 570 may include the fixing part 575 of which some portion extend outwardly. Such a configuration intends to obtain a space allowing the lower case 560 to be coupled to the middle body 510. This will be described with reference to FIGS. 13 and 14.

The lower case 560 may be disposed on a portion of the lens 570 and may be screw-coupled to the middle body 510. The lower case 560 covers a portion of the lens 570 and is coupled to the middle body 510. Accordingly, the lens 570 is fixed.

Referring to the cross sectional view of FIG. 13 taken along line A-A passing through the screw recess, the lens 570 does not extend outwardly to the screw recess of the lower case 560. This intends to not to block a path used to screw-couple the lower case 560 to the middle body 510. However, if the screw recess is disposed more outside than that shown in FIG. 16, the lens 570 may extend outwardly to the screw recess of the lower case 560.

Referring to the cross sectional view of FIG. 14 taken along line B-B not passing through the screw recess, it can be seen that the lens 570 projects outwardly to a portion of the lower case 560.

The fixing part 575 extending outwardly from the lens 570 is inserted and fixed between the lower case 560 and the middle body 510, so that the lens 570 can be fixed without being directly screw-coupled to the lower case 560 and the middle body 510.

Through the described configuration, the lens of the lighting device can be fixed to a particular position in the lighting device without coupling a screw to the lens. Accordingly, it is possible to simply assemble the lighting device and to easily form the lens.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

The invention claimed is:

1. A lighting device comprising:

a light emitting module;

a middle body which is provided on the light emitting module;

a heat sink fan which is provided on the middle body;

an upper case which is provided on the heat sink fan and is coupled to the middle body; and a lower case which is provided under the middle body and is coupled to the middle body, wherein the lower case has an air inlet, wherein the air inlet is connected to a first space between the heat sink fan and the upper case, wherein die first space is a closed space formed by the heat sink fan and the upper case, wherein the middle body has a first air path connecting the air inlet with the first space, wherein the middle body has an air outlet disposed at a side surface of the middle body and in communication with an outside directly, wherein the air outlet is connected to a second space between the middle body and the heat sink fan, wherein the middle body has a second air path connecting the air outlet with the second space, wherein the heat sink fan is disposed between the middle body and the upper case, wherein the heat sink fan injects air m the direction of the second space from the first space, wherein air introduced through the air inlet comes into the first space by the fast air path of the middle body, the air in the first space moves to the second space by the heat sink fan, and the air in the second space is emitted through the air outlet by the second air path of the middle body, the middle bode includes a top surface and a bottom surface, wherein the side surface of the middle body connects the top surface of the middle body and the bottom surface of the middle body, wherein the light emitting module is provided on the top surface of the middle body, and wherein the heat fan is provided between the bottom surface of the middle body and the upper case.

2. The lighting device, of claim 1, wherein the air inlet has a first air inlet and a second air inlet facing to the first air inlet, a center of the first air inlet is not overlapped with the air outlet in a perpendicular direction, and wherein the perpendicular direction is a direction toward the bottom surface of middle body from the top surface of the middle body.

3. The lighting device of claim 2, wherein the lower case has an air outlet provided between the first inlet and the second air inlet connected to the second space, and the air outlet of the lower case is overlapped with the air outlet of the middle body in the perpendicular direction.

4. The lighting device of claim 1, wherein the air inlet is disposed on the circumference of the lower case.

5. The lighting device of claim 1, further including a lens which is coupled to the lower case and projects in a direction in which light generated from the light emitting module is emitted.

6. A lighting device comprising:

a body;

a light emitting module provided on the body and including a substrate and a plurality of light emitting devices provided on the substrate;

a lens provided on one side of the light emitting module; and a lower case coupled to at least a portion of the lens, wherein the lower case is coupled to the body, wherein a portion of the lens is disposed between the lower case and the body, wherein the lower case is screw-coupled to the body, wherein the lens includes an optical part allowing light generated from the light emitting module to transmit therethrough and fixing parts extending outwardly from the optical part in opposite directions, respectively, wherein the fixing parts are provided between the lower case and the body, wherein the optical part projects higher than the lower case, wherein the optical part includes an upper optical portion and a side optical portion extending from an edge of the upper optical portion, wherein the optical part includes a plurality of lens units corresponding to the plurality of the light emitting devices one-to-one and is disposed under the upper optical portion, wherein the lower case has a screw recess, and wherein the fixing part does not extend outwardly to the screw recess of the lower case, wherein the fixing parts comprise a first fixing part extending from a first portion of the side optical portion and a second fixing part extending from a second portion of the side optical portion, wherein the first portion of the side optical portion and the second portion of the side optical portion face each other, wherein the fixing parts are provided on a part of the side optical portion, wherein first width of the lens is wearer than a second width of the lens, wherein the first width is a width of the lens on a first axis passing through a center of the optical part and central portion of the first and second fixing parts, and wherein the second width is a width of the lens on a second axis perpendicular to the first axis.

7. The lighting device of claim 6, wherein the body includes:

a heat sink provided on the other side of the light emitting module;

a heat sink fan provided apart from the heat sink; and an upper case covering the heat sink and the heat sink fan.

8. The lighting device of claim 7, further including a middle body which is provided between the upper case and the lower case and includes a heat sink provided on the light emitting module.

9. The lighting device of claim 8, wherein the middle body has a first air outlet.

10. The lighting device of claim 8, wherein a first air inlet and a second air inlet opposite to the first air inlet are provided in the lower case, wherein the first fixing part is provided between the first air inlet and the second air inlet.

11. The lighting device of claim 10, wherein the first air inlet and the second air inlet have a circular arc shape.

12. The lighting device of claim 10, further including a second air outlet in the lower case.

13. The lighting device of claim 12, wherein the second air outlet has a circular are shape.

14. The lighting device of claim 12, wherein the air inlet is provided closer to the center of the lower case than the second air outlet.

15. The lighting device of claim 3, wherein the air inlet of the lower case is provided closer to the center of the lower case than the air outlet of the lower case.

16. The lighting device of claim 3, wherein at least one of the air inlet of the lower case and the air outlet of the lower case has a circular arc shape.

17. The lighting device of claim 1, wherein the middle body includes a partition separating the first air path, and the second air path.

18. A lighting device comprising:

a light emitting module;

a middle body which is provided on the light emitting module;

a heat sink fan which is provided on the middle body;

an upper case Which is provided on the heat sink fan and is coupled to the middle body; and a lower case which is provided under the middle body and is coupled to the middle body, wherein an air outlet is provided between a side surface of the lower case and a side surface of the upper case, wherein the lower case has an air inlet, wherein the air inlet is in communication with a first space between the heat sink fan and the upper case, wherein the first space is a closed space formed by the heat sink fan and the upper case, wherein the middle body has a first air path connecting the air inlet with die first space, wherein the air outlet is in communication with a second space between the middle body and the heat sink fan, wherein the middle body has a second air path connecting the air outlet with the second space, wherein the heat sink fan is disposed between the middle body and the upper case, wherein the heat sink fan injects air in the direction of the second space from the first space, wherein the air outlet communicates with an outside directly, wherein the middle body includes a first surface on which the light emitting module is provided, a second surface opposite the first surface, and a side surface, wherein the second surface includes a heat sink, and wherein air provided from the heat sink fan passes the heat sink and exhausts through the air outlet, wherein the first air path is separate from the second air path, wherein the middle body includes a portion formed in the first air path, and wherein the air outlet is not provided in the portion of the middle body.

19. The lighting device of claim 18, wherein the air outlet is provided at the side surface of the middle body.

* * * * *